US008177563B1

(12) United States Patent
Vernica

(10) Patent No.: US 8,177,563 B1
(45) Date of Patent: May 15, 2012

(54) SWIVEL GROUND CLAMP FOR BARE ARMOR WIRE

(76) Inventor: Mike Vernica, Whittier, CA (US)

( * ) Notice: Subject to any disclaimer, the term of this patent is extended or adjusted under 35 U.S.C. 154(b) by 22 days.

(21) Appl. No.: 12/913,411

(22) Filed: Oct. 27, 2010

(51) Int. Cl.
*H01R 13/168* (2006.01)

(52) U.S. Cl. ..... 439/100

(58) Field of Classification Search ..... 439/98–100
See application file for complete search history.

(56) References Cited

U.S. PATENT DOCUMENTS

| | | | | |
|---|---|---|---|---|
| 1,899,309 | A | 2/1933 | Buchanan | |
| 2,077,613 | A | 4/1937 | Bondeson | |
| 2,116,776 | A | 5/1938 | Bondeson | |
| 533,897 | A | 12/1950 | Reddock | |
| 3,058,087 | A | 10/1962 | Piasecki | |
| 3,568,128 | A | 3/1971 | Taylor | |
| 3,639,677 | A | 2/1972 | Bain | |
| 3,798,585 | A * | 3/1974 | Thompson et al. | 439/98 |
| 3,901,577 | A | 8/1975 | Philibert et al. | |
| 4,820,901 | A | 4/1989 | Peviani | |
| 5,306,170 | A * | 4/1994 | Luu | 439/100 |
| 5,364,281 | A | 11/1994 | Leto | |
| 5,460,532 | A | 10/1995 | Leto | |
| 5,480,311 | A * | 1/1996 | Luu | 439/100 |
| 6,976,857 | B1 * | 12/2005 | Shukla et al. | 439/100 |
| 7,621,763 | B2 * | 11/2009 | Clark et al. | 439/100 |
| 7,780,461 | B1 * | 8/2010 | Vernica | 439/100 |

* cited by examiner

*Primary Examiner* — Truc Nguyen
(74) *Attorney, Agent, or Firm* — Kenneth L. Green

(57) ABSTRACT

A ground fitting allows electrical connection between a ground wire carried in a metal sheathing, and a ground point such as a water spigot on a short pipe extending from a wall. The pipe clamp is tightened on the short pipe or ground rod. The metal sheathing is cut to expose a short length of ground wire. The ground wire is inserted into the wire clamp, and the metal sheathing is inserted between a clamping plate and clamp seat at the near end of the wire clamp. A ground screw is tightened against the ground wire to hold the ground wire in the wire clamp and plate screws securing the clamping plate are tightened to secure the sheathing between the clamping plate and clamp seats. The wire clamp is attached to the pipe clamp selectively parallel or perpendicular to the short pipe or ground rod to compete the ground fitting.

17 Claims, 4 Drawing Sheets

SWIVEL GROUND CLAMP FOR BARE ARMOR WIRE

BACKGROUND OF THE INVENTION

The present invention relates to electrical grounding and bonding, and more particularly to a ground fitting for easily grounding or bonding a ground wire carried in spiral metal sheathing (e.g., an armored cable) at an endpoint to a pipe extending a short distance from a wall.

Ground wires frequently require protection from damage. The ground wire is generally a heavy gauge wire, for example eight gauge or six gauge solid, or four gauge stranded, and is generally uninsulated. A common method for protecting a ground wire is to carry the ground wire in a spiral metal sheathing (e.g., armored cable), thereby creating an armored ground wire. Such spiral metal sheathing provides the desired protection to the ground wire.

It is often necessary to connect the ground wire to a ground member (or ground point) such as a water spigot extending from the side of a structure. Unfortunately, known grounding clamps do not allow the clamp to be attached to the pipe between the wall and spigot, and allow the ground wire to be attached in the most desirable manner parallel to the wall to keep the ground wire close to the wall.

Therefore, a need remains for a ground fitting (or clamp) and method of use which clamps to a spigot pipe and facilitates running the ground wire parallel to the wall for the entire length of the ground wire.

BRIEF SUMMARY OF THE INVENTION

The present invention addresses the above and other needs by providing a ground fitting which allows simplified electrical connection between a ground wire carried in a metal sheathing, and a ground point such as a water spigot on a short pipe extending from a wall, or to a ground rod. The ground fitting comprises a wire clamp and a pipe clamp. The metal sheathing is cut and a short length removed to expose a short length of ground wire. The ground wire is inserted axially into the wire clamp, and the end of the metal sheathing carrying the ground wire is inserted axially between a clamping plate and clamp seat at a near end of the wire clamp. A ground screw is tightened against the ground wire to hold the ground wire in the wire clamp and plate screws securing the clamping plate are tightened to secure the sheathing between the clamping plate and clamp seats. The pipe clamp is tightened on the short pipe or ground rod, and the ground clamp is attached to the pipe clamp parallel to the short pipe or ground rod, or perpendicular to the short pipe or ground rod.

In accordance with one aspect of the invention, there is provided an end point ground fitting. The ground fitting includes a wire clamp and a pipe clamp. The wire clamp includes an armored cable entry, an armored cable clamp, a ground cable passage, and a ground wire screw. The armored cable clamp comprises a clamp seat facing a clamping plate for sandwiching the armored cable end inserted into the armored cable entry. The clamp seat and the clamping plate include interior concave dished portions including interior ridges for engaging an exterior spiral surface of the armored cable to retain the armored cable end in the armored cable entry. The ground wire passage allows axial inserting of the ground wire into the ground wire passage. The ground wire screw intersects the ground wire passage and is approximately perpendicular to the ground wire passage to intersect and thereby clamp the ground wire in wire clamp. The pipe clamp and the wire clamp include cooperating faces providing four attaching alignments allowing the ground cable to be aligned either parallel to, or perpendicular to, the short pipe.

In accordance with another aspect of the invention, there is provided a method for connecting an armored ground wire to a short pipe carrying a spigot. The method includes: attaching a pipe clamp to the short pipe; cutting a short length of the metal armored cable sheath surrounding a ground wire to expose a short length of the ground cable, axially inserting the exposed ground wire into a ground cable mouth of a wire clamp while inserting the armored cable end between a clamping plate and clamp seat at the near end of the wire clamp; tightening a wire clamp screw to grip the ground wire in place in the ground wire passage, tightening the armored cable clamp screws to grip the armored cable end between the clamping plate and clamp seat; and attaching the wire clamp to the pipe clamp with the ground wire perpendicular to the short pipe. Tightening the armored cable clamp may comprise tightening the clamping plate to sandwich the armored cable end between a concave dished portion of the clamping plate and clamp seat and intersecting at least one ridge on the concave dish portion with exterior spiral surfaces of the armored cable end to retain the armored cable end in the wire clamp. In one embodiment, ridges are provided on both the clamping plate and clamp seat to further secure the end of the metal sheathing sufficiently to meet code requirements.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
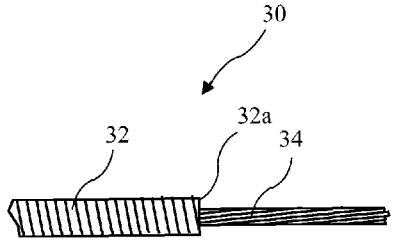
FIG. 1 is an armored ground wire suitable for use with the present invention.

An armored (or sheathed) ground wire 30 suitable for use with the present invention is shown in FIG. 1. The armored ground wire 30 is generally protected by an armored cable sheath 32. formed from a metal spiral allowing flexing while protecting the ground wire 34 inside the armored cable sheath 32.

Figure 2C:
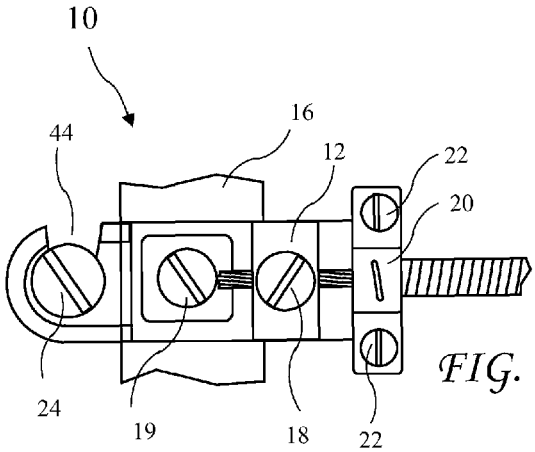
FIG. 2C is a top view of the ground fitting according to the present invention connecting the sheathed ground wire to the short pipe.
Figure 2A:
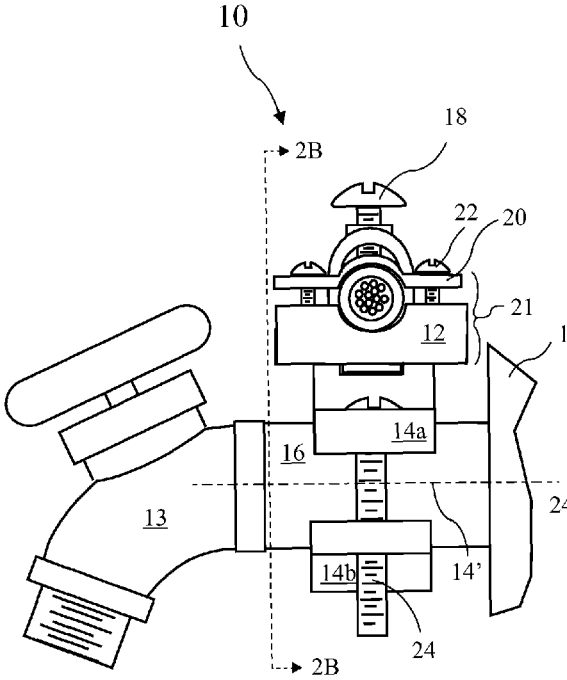
FIG. 2A is a side view of a ground fitting according to the present invention connecting a sheathed ground wire to a short pipe.
Figure 2B:
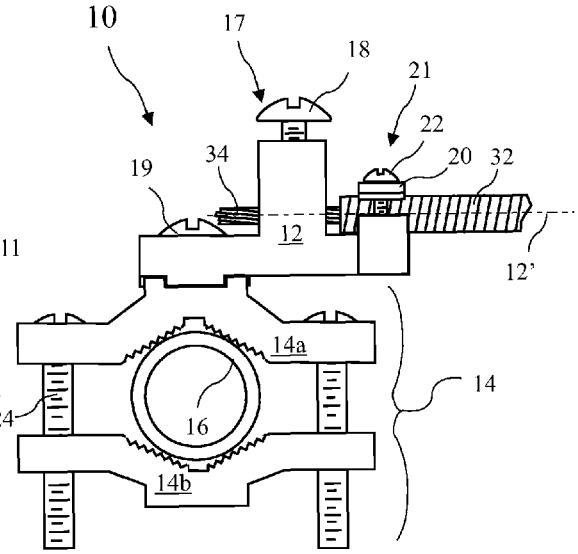
FIG. 2B is a front view of the ground fitting according to the present invention connecting the sheathed ground wire to the short pipe.

FIG. 2A is a side view of a ground fitting 10 according to the present invention connecting a sheathed ground wire 30 to a short pipe 16 reaching from a wall 11 to a spigot 13, a front view of the ground fitting connecting the sheathed ground wire 30 to the short pipe 16 is shown in FIG. 2B, and a top view of the ground fitting 10 connecting the sheathed ground wire 30 to the short pipe 16 is shown in FIG. 2C. The ground fitting 10 in comprised of a two piece pipe clamp 14 comprising a top portion 14*a* and a bottom portion 14*b*, and a cable clamp 12. The pipe clamp 14 is fixed on the short pipe 16 by tightening two screws 24. Details of the pipe clamp 14 are disclosed in FIGS. 3A - 5B below. The wire clamp 12 is attached to the pipe clamp 14 by screw 19 and includes an armored cable sheath clamp portion 21 and a ground wire clamp portion 17. The ground wire 34 is held in the ground wire clamp portion 17 by screw 18, and the armored cable sheath 32 is held in the armored cable sheath clamp portion 21 by a clamping plate 20. The pipe clamp 14 has a pipe clamp centerline 14' and the wire clamp 12 has a wire clamp centerline 12'.

Figure 3C:
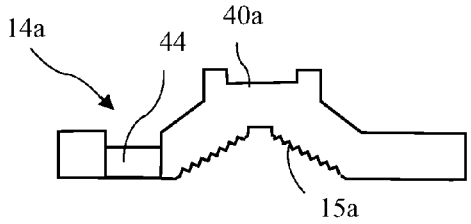
FIG. 3C is a rear view of the pipe clamp top according to the present invention.
Figure 3A:
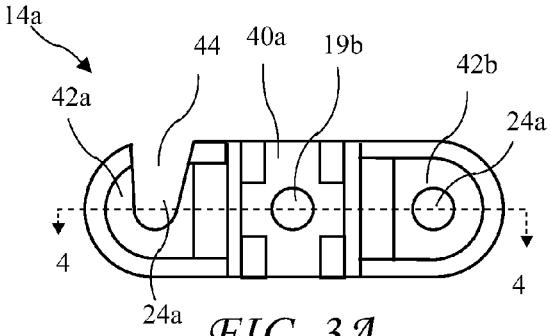
FIG. 3A is a top view of a pipe clamp top according to the present invention.
Figure 4:
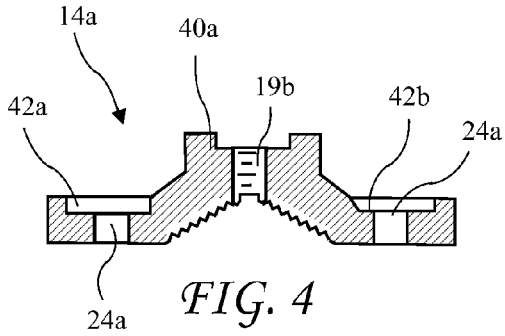
FIG. 4 is a cross-sectional view of the pipe clamp top taken along line 4-4 of FIG. 3A.
Figure 3B:
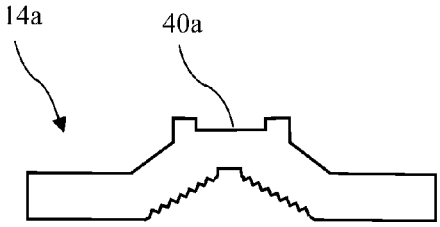
FIG. 3B is a front view of the pipe clamp top according to the present invention.
Figure 3D:
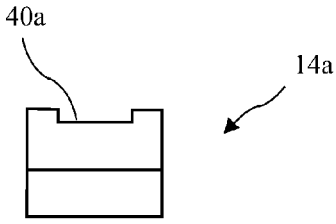
FIG. 3D is an end view of the pipe clamp top according to the present invention.

A top view of a pipe clamp top portion 14*a* according to the present invention is shown in FIG. 3A, a front view of the pipe clamp top portion 14*a* is shown in FIG. 3B, is a rear view of the pipe clamp top portion 14*a* is shown in FIG. 3C, an end view of the pipe clamp top portion 14*a* is shown in FIG. 3D, and a cross-sectional view of the pipe clamp top portion 14*a* taken along line 4-4 of FIG. 3A is shown in FIG. 4. The pipe clamp top portion 14*a* includes a pair of downward facing grooved surfaces 15*a* which are tightened against the short pipe 16 to hold the pipe clamp in place. Two vertical screw passages 24*a* on opposite sides of the pipe clamp top portion 14*a* provide passage of the screws 24. The screw passages 24*a* reside in recesses 42*a* and 42*b*. A mouth 44 opens one of the recesses 24*a* allowing the pipe clamp to be positioned on the small pipe 16 without completely removing the screws 24. The raised center of the pipe clamp top portion 14*a* includes screw passage 19*b* centered in a rectangular platform with recessed cross shape second mating surface 40*a* for attachment of the wire clamp 12.

Figure 5B:
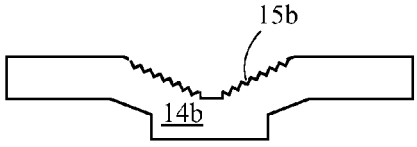
FIG. 5B is a front view of the pipe clamp bottom according to the present invention.
Figure 5A:
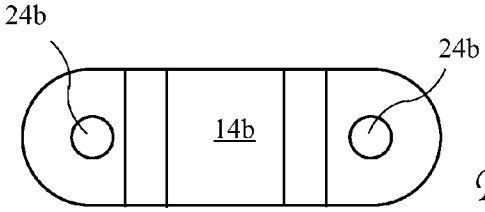
FIG. 5A is a bottom view of a pipe clamp bottom according to the present invention.

A bottom view of a pipe clamp bottom portion 14*b* according to the present invention is shown in FIG. 5A and a front view of the pipe clamp bottom portion 14*b* is shown in FIG. 5B. The pipe clamp bottom portion 14*b* includes threaded holes 24*b* aligned with the holes 24*a* to receive the screws 24 to tighten the pipe clamp on the small pipe 16. The pipe clamp bottom portion 14*b* includes a pair of upward facing grooved surfaces 15*b* which are tightened against the short pipe 16 to hold the pipe clamp in place.

Figure 6C:
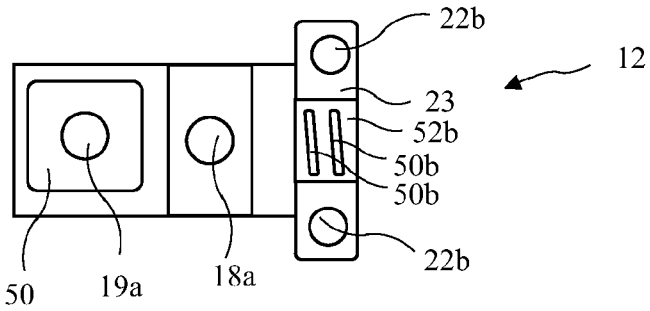
FIG. 6C is a top view of the wire clamp according to the present invention.
Figure 6A:
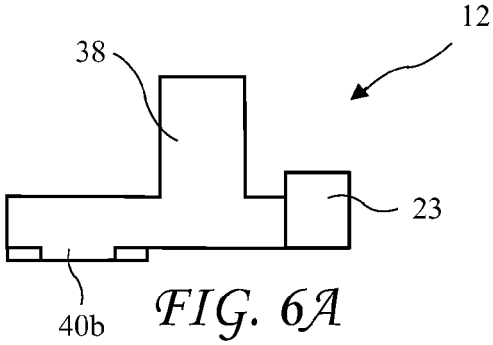
FIG. 6A is a side view of a wire clamp according to the present invention.
Figure 6B:
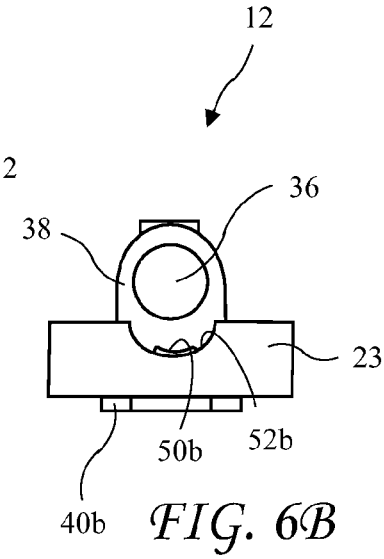
FIG. 6B is an end view of the wire clamp according to the present invention.
Figure 6D:
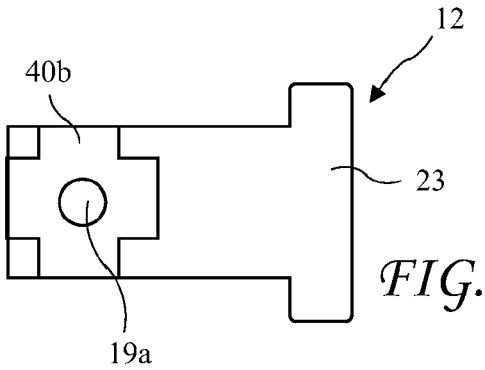
FIG. 6D is a bottom view of the wire clamp according to the present invention.

A side view of a wire clamp 12 according to the present invention is shown in FIG. 6A, an end view of the wire clamp 12 is shown in FIG. 6B, a top view of the wire clamp 12 is shown in FIG. 6C, and a bottom view of the wire clamp 12 is shown in FIG. 6D. The wire clamp 12 includes a raised arch 38 having a ground wire passage 36 for entry of the ground wire 34, and a threaded screw passage 19*a* for the screw 19 allowing the screw 19 to be tightened against the ground wire 34 inserted into the ground wire passage 36. A slightly raised entry portion 23 on the near (to the ground wire) end of the wire clamp includes a curved seat 52*b* for cooperation with the clamping plate 20 forming the armored cable sheath clamp 21 to sandwich the armored cable sheath 32. Threaded screw passages 22*b* receive the screws 22 to tighten the clamping plate 20. The curved seat 23*a* may include two shallow ridges 50*b* (see FIGS. 7A-8) to engage the armored cable sheath 32.

The wire clamp 12 includes a downward facing horizontal cross first mating surface 40*b* for cooperation with the recessed cross shape 40*b* on the pipe clamp top portion 14*a* for attachment of the wire clamp 12 to the pipe clamp top portion 14*a*. A screw passage 19*a* is provided for the screw 19 to secure the wire clamp 12 to the pipe clamp top portion 14*a*. The cross shape of the horizontal crosses 40*a* and 40*b* allow the wire clamp to be positioned in any one of four directions for routing the sheathed ground wire 30.

Figure 7A:
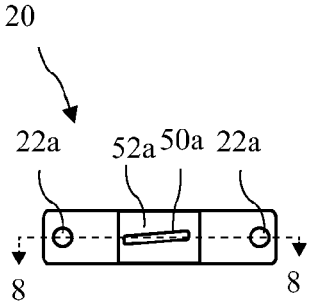
FIG. 7A is a top view of a clamping plate according to the present invention.
Figure 7B:
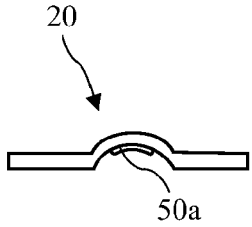
FIG. 7B is a side view of the clamping plate according to the present invention.
Figure 8:
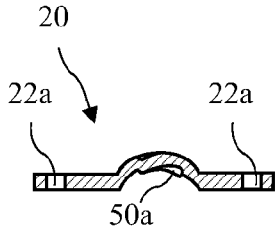
FIG. 8 is a cross-sectional view of the clamping plate according to the present invention taken along line 8-8 of FIG. 7A.

A top view of a clamping plate 20 according to the present invention for holding the armored cable sheath 32. is shown in FIG. 7A, a side view of the clamping plate 20 is shown in FIG. 7B, and a cross-sectional view of the clamping plate 20 taken along line 8-8 of FIG. 7A is shown in FIG. 8. The clamp plate 20 includes concave dished portions facing the concave clamp seat 23*a* and the plate 20 includes a shallow ridge 50*a* inside the concave dished portion 52*a* turned slightly away from the direction of the ground wire passage 36 and approximately aligned with an exterior spiral surface of the armored cable sheath 32. for engaging the exterior spiral surface of the armored cable to retain the armored cables ends in the armored cable entries. Previous apparatus for clamping armored cable ends has failed to meet new electrical requirements requiring, for example, the clamping to hold under 50 pounds of tension. The combined ridges 50*a* and 50*b* significantly increase the force required to pull the armored cable sheath 32. out of the ground fitting 10 thereby meeting the new requirements. The ridges extend approximately 0.035 inches from the concave dished surface to engage the armored cable.

Figure 9B:
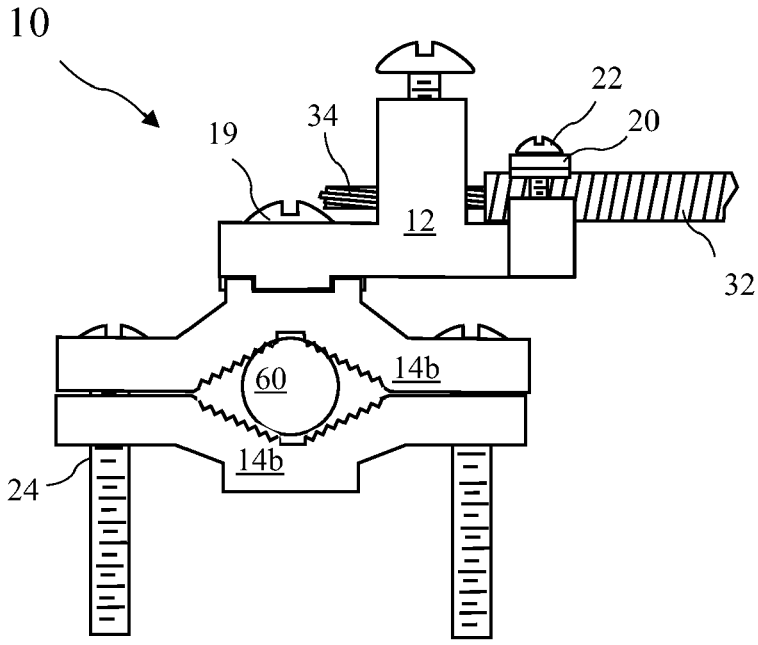
FIG. 9B is a top view of the ground fitting according to the present invention attached to the ground rod.
Figure 9A:
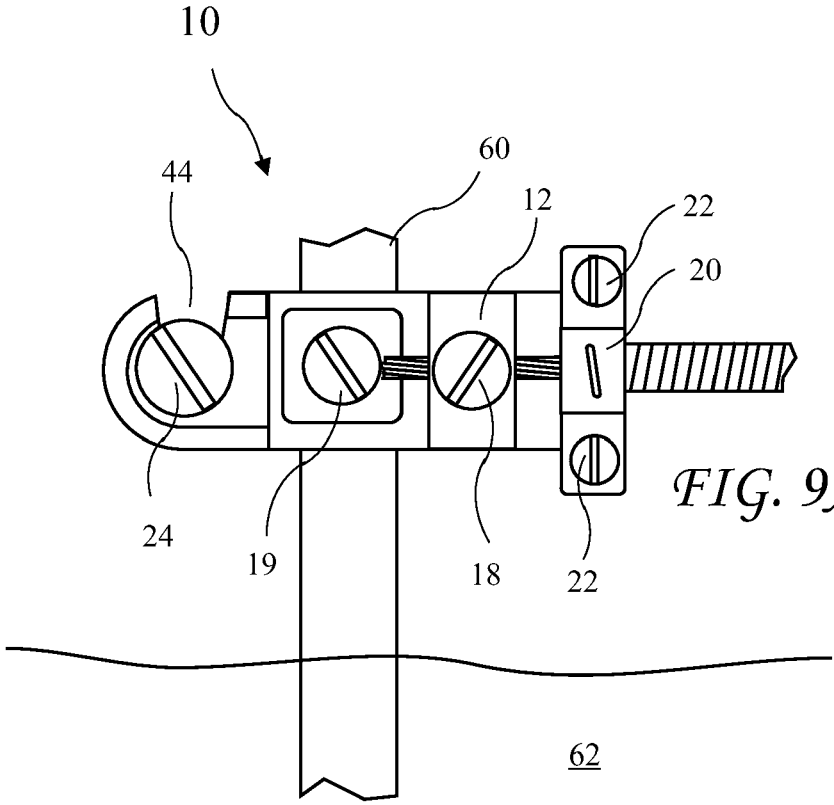
FIG. 9A is a front view of the ground fitting according to the present invention attached to a ground rod.

A front view of the ground fitting 10 according to the present invention attached to a ground rod 60 is shown in FIG. 9A and a top view of the ground fitting 10 attached to the ground rod 60 is shown in FIG. 9B. Ground rods 60 are generally eight or ten feet long with one foot exposed above ground 62. The ground fitting 10 allow convenient attaching the armored ground wire 30 to the ground rod 60 with the armored ground wire The screws 18 and 24 and the clamping plates 20 are preferably zinc coated steel, and more preferably have a minimum approximately 0.001 inch thick zinc coating. The ground wire grasping portion 12 and the ground point plate 14 are preferably made of a copper alloy and are more preferably approximately 80 percent copper. The screws 22 are preferably 10-24 stainless steel screws for additional strength.

While the invention herein disclosed has been described by means of specific embodiments and applications thereof, numerous modifications and variations could be made thereto by those skilled in the art without departing from the scope of the invention set forth in the claims.

I claim:

1. A ground fitting comprising:

a wire clamp having a wire clamp centerline residing parallel with wires held by the wire clamp, and a first mating surface, the wire clamp comprising:

an armored cable sheath clamp portion for grasping an armored cable sheath end inserted into the wire clamp; and a ground wire clamp portion behind the armored cable sheath clamp for grasping a ground wire carried in the armored cable sheath;

a pipe clamp having a pipe clamp centerline residing parallel with a pipe held by the pipe clamp, the pipe clamp comprising:

a pipe clamp top portion having a second mating surface cooperating with the first mating surface for attachment of the wire clamp to the pipe clamp; and a pipe clamp bottom portion connected to the pipe clamp top portion to sandwich a pipe in the pipe clamp for forming an electrical connection between the ground fitting and the pipe, wherein the wire clamp is rotatably attached to the pipe clamp by cooperation of the first mating surface and the second mating surface to allow changing the orientation of the wire clamp centerline with respect to the pipe clamp centerline.

2. The ground fitting of claim 1, wherein the second mating surface on the pipe clamp top portion includes second features and the first mating surface on the ground wire clamp portion of the wire clamp includes first mating features configured to engage with the ground wire running perpendicular to the pipe, the pipe clamp is attached to.

3. The ground fitting of claim 2, wherein the second mating surface on the pipe clamp top portion cooperates with the first mating surface of the wire clamp to the pipe clamp mounting the wire clamp with the ground wire running extending from the wire clamp in any one of four directions.

4. The ground fitting of claim 3, wherein the second mating surface on the pipe clamp top portion for attachment of the wire clamp comprises a cross shape which cooperates with the first mating surface on the wire clamp comprising a cooperating cross shape.

5. The ground fitting of claim 1, wherein, the ground wire clamp portion comprises a ground wire passage and a ground wire screw intersecting the ground wire passage approximately perpendicular to the ground wire passage and approximately laterally centered on the ground wire passage to intersect and thereby clamp the ground wire in the sheathed ground wire grasping portion.

6. The ground fitting of claim 1, wherein the armored cable sheath clamp portion comprises a downward concave clamp seat and an upward concave clamping plate for sandwiching the armored cable sheath to secure the armored end in the wire clamp.

7. The ground fitting of claim 6, wherein the clamp seats include a clamp seat ridge facing the armored cable for engaging the armored cable to secure the armored cable end in the wire clamp.

8. The ground fitting of claim 6, wherein the clamping plate includes a plate ridge for engaging the armored cable sheath to secure the armored cable in the wire clamp.

9. An electrical ground connection comprising:

an armored ground wire comprising:

a ground wire; and armored cable sheath;

a wire clamp having a wire clamp centerline residing parallel with wires held by the wire clamp, and a first mating surface, the wire clamp comprising:

an armored cable sheath clamp portion comprising:

a downward concave clamp seat including a clamp seat ridge facing the armored cable sheath for engaging the armored cable sheath to better secure the armored ground wire in the wire clamp; and an upward concave clamping plate cooperating with the downward concave clamp seat to sandwich the armored cable sheath to secure the armored ground wire in the wire clamp, the clamping plate including a plate ridge for engaging the armored cable sheath to better secure the armored ground wire in the wire clamp; and a ground wire clamp portion behind the armored cable sheath clamp portion including a ground wire passage and a ground wire screw intersecting the ground wire passage approximately perpendicular to the ground wire passage and approximately laterally centered on the ground wire passage to intersect and thereby clamp the ground wire in the sheathed ground wire grasping portion for grasping a ground wire carried in the armored cable sheath;

a pipe clamp having a pipe clamp centerline residing parallel with a pipe held by the pipe clamp, the pipe clamp comprising:

a pipe clamp top portion having a second mating surface cooperating with the first mating surface in exactly four angular positions spaced 90 degrees apart, the second mating surface comprising an upward facing cross shape cooperating with a downward facing cross shape second mating surface on the wire clamp, to permit mounting the wire clamp to the pipe clamp with the ground wire running in any one of four directions including a direction perpendicular to the pipe the pipe clamp is attached to;

a pipe clamp bottom portion connected to the pipe clamp top portion to sandwich a pipe in the pipe clamp for forming an electrical connection between the ground fitting and the pipe; and screws at each end of the pipe clamp to connect the pipe clamp top portion to the pipe clamp bottom portion to firmly sandwich the pipe between the pipe clamp top portion to the pipe clamp bottom portion.

10. A method for connecting an armored ground wire to a short pipe carrying a spigot, the method comprising:

attaching a pipe clamp to the short pipe;

cutting a short length of the metal armored cable sheath surrounding a ground wire to expose a short length of the ground cable;

axially inserting the exposed ground wire into a ground wire passage of a wire clamp while inserting the armored cable end between a clamping plate and clamp seat at the near end of the wire clamp;

tightening a wire clamp screw to grip the ground wire in place in the ground wire passage;

tightening the armored cable clamp screws to grip the armored cable end between the clamping plate and clamp seat rotating the wire clamp with respect to the pipe clamp to a position avoiding interference with proximal structures; and attaching the wire clamp to the pipe clamp with the ground wire in the position avoiding the proximal structure.

11. The method of claim 10, wherein tightening a ground wire clamp comprises tightening a ground wire screw against the ground wire, wherein the ground wire screw is approximately centered on the ground wire passage.

12. The method of claim 11, wherein tightening the clamping plate to sandwich the armored cable end between the clamping plates and clamp seat comprises tightening stainless steel screws securing the clamping plate to sandwich the armored cable end between the clamping plate and clamp seat.

13. The method of claim 12, wherein tightening the armored cable clamps comprises tightening a clamping plate to sandwich the armored cable end between a concave dished portion of the clamping plate and clamp seat and intersecting at least one ridge on the concave dish portion with exterior spiral surface of the armored cable end to retain the armored cable end in the armored cable entry.

14. The method of claim 13, wherein tightening the armored cable clamp comprises tightening clamping plate to sandwich the armored cable end between a concave dished portion of the clamping plate and clamp seat and intersecting at least one ridge on the concave dish portion of the clamp seat and at least one ridge on the concave dish portion of the clamping plate with the exterior spiral surface of the armored cable end to retain the armored cable end in the armored cable entries.

15. The ground fitting of claim 1, wherein rotating the wire clamp with respect to the pipe clamp to a position avoiding interference with proximal structures comprises rotating the wire clamp with respect to the pipe clamp to one of four discrete angular positions spaced 90 degrees apart.

16. The ground fitting of claim 1, wherein:

the first mating surface has a generally square outline and includes a raised cross shape centered in the square outline; and The second mating surface has a generally square shape and includes four raised squares, one in each corner of the square outline, wherein the four raised squares engage the raised cross shape to position the ground wire in one of four angular positions spaced 90 degrees apart.

17. The ground fitting of claim 1, wherein:

the first mating surface has a generally square outline and includes a raised cross shape centered in the square outline; and The second mating surface has a generally square shape and includes four raised squares, one in each corner of the square outline, wherein the four raised squares engage the raised cross shape to position the ground wire in one of four angular positions spaced 90 degrees apart.

* * * * *